US009683399B2

(12) United States Patent
Wilbs

(10) Patent No.: US 9,683,399 B2
(45) Date of Patent: Jun. 20, 2017

(54) GUIDE FOR SLIDING DOORS

(71) Applicant: alfer Aluminium Gesellschaft mbH, Wutoschingen-Horheim (DE)

(72) Inventor: Thomas Wilbs, Uhlingen-Birkendorf (DE)

(73) Assignee: ALFER ALUMINIUM GESELLSCHAFT MBH, Wutoschingen-Horheim (DE)

( * ) Notice: Subject to any disclaimer, the term of this patent is extended or adjusted under 35 U.S.C. 154(b) by 122 days.

(21) Appl. No.: 14/469,157

(22) Filed: Aug. 26, 2014

(65) Prior Publication Data

US 2014/0361673 A1 Dec. 11, 2014

Related U.S. Application Data

(62) Division of application No. 13/652,044, filed on Oct. 15, 2012, now abandoned.

(51) Int. Cl.

| | |
|---|---|
| ***B61D 19/00*** | (2006.01) |
| ***E05D 15/06*** | (2006.01) |
| ***A47B 96/20*** | (2006.01) |
| ***E05D 15/16*** | (2006.01) |

(52) U.S. Cl.

CPC ..... *E05D 15/0686* (2013.01); *A47B 96/20* (2013.01); *E05D 15/0656* (2013.01); *E05D 15/0691* (2013.01); *E05D 15/165* (2013.01); *E05Y 2900/20* (2013.01); *Y10T 16/373* (2015.01); *Y10T 16/379* (2015.01)

(58) Field of Classification Search

CPC ..... E06B 3/42; E06B 3/4663; A47B 96/14

USPC ..... 16/96 R, 87.2, 87.4 R; 160/118, 119; 49/404, 410, 411, 413; 312/138.1, 139.2

See application file for complete search history.

(56) References Cited

U.S. PATENT DOCUMENTS

| | | | | |
|---|---|---|---|---|
| 1,782,819 A * | 11/1930 | Hansen | A47F 3/125 | 16/100 |
| 3,601,462 A * | 8/1971 | Fenwick | E06B 3/4663 | 312/139.2 |
| 3,636,661 A * | 1/1972 | Strawsine | A47B 67/02 | 312/209 |
| 3,731,430 A * | 5/1973 | Dallaire | E06B 3/4681 | 49/413 |

(Continued)

FOREIGN PATENT DOCUMENTS

GB 1281521 A * 7/1972 ..... E06B 3/4663

*Primary Examiner* — Robert J Sandy
*Assistant Examiner* — Matthew Sullivan
(74) *Attorney, Agent, or Firm* — Notaro, Michalos & Zaccaria P.C.

(57) ABSTRACT

A guide device for sliding doors for shelves has at least one guide rail, each guide rail have a guide region for guiding sliding doors and at least one fastening region connected to the guide region for fastening the guide device to shelves. The guide regions in their cooperation form a guide arrangement and all the fastening regions in their cooperation form a fastening arrangement. In order to provide a guide device which can be used universally and which can be fastened subsequently to shelves, the fastening arrangement is disposed relative to the guide arrangement in the installed position in such a manner that the guide arrangement is accessible from below and above for sliding doors and at least partially covers vertical surfaces of the shelves.

18 Claims, 12 Drawing Sheets

(56) References Cited

U.S. PATENT DOCUMENTS

| | | | | | |
|---|---|---|---|---|---|
| 4,067,161 | A * | 1/1978 | Rensch | A47B 47/04 | 312/139.2 |
| 4,148,535 | A * | 4/1979 | Fenwick | A47B 47/04 | 16/95 R |
| 7,150,126 | B2 * | 12/2006 | Rivera | B60J 5/06 | 49/408 |

* cited by examiner

GUIDE FOR SLIDING DOORS

CROSS-REFERENCE TO RELATED APPLICATION

This is a divisional application of U.S. application Ser. No. 13/652,044, filed Oct. 15, 2012, and which is incorporated here by reference, and which claimed priority of German Patent Application No. 10 2011 054 800.9, filed Oct. 25, 2011. That priority claim, and the German priority document, are also fully incorporated here.

FIELD AND BACKGROUND OF THE INVENTION

The present invention relates to a guide device for sliding doors for shelves, comprising at least one guide rail, wherein each guide rail has a guide region for guiding sliding doors and at least one fastening region connected to the guide region for fastening the guide device to shelves, wherein all the guide regions in their cooperation form a guide arrangement and all the fastening regions in their cooperation form a fastening arrangement, and an arrangement of at least two guide devices for sliding doors for shelves.

Guide devices for sliding doors for cupboards are generally known. Since cupboards are usually intended to provide a storage space which is closed with respect to the surroundings, which nevertheless is accessible from outside, these items of furniture are fitted with doors, in particular sliding doors, ex works. The guide rails used for the guidance of the sliding doors are usually let into supporting components of the cupboards or placed on such components.

The Unexamined Laid-Open Patent Application CH 700 980 A1 describes a guide rail for sliding doors which is inserted in a pre-fabricated groove in the ceiling of the cupboard. The guide rail has a groove which is open towards the bottom, which is suitable for receiving running gear on which the sliding doors are arranged. The guide rail is glued into the groove in the ceiling of the cupboard or non-detachably fastened therein in some other way. In order to be able to fasten this guide rail subsequently to any cupboard, appreciable structural measures were required, for example, milling a groove in the ceiling of the cupboard. A subsequent fastening of the guide rail to a shelf is therefore out of the question.

The Unexamined Laid-Open Patent Application EP 0 179 993 A2 discloses a cabinet with at least one sliding door, wherein the sliding door is mounted slidingly in a bottom rail and in a top rail. These rails are configured as profiles having at least one groove, wherein the profiles are absolutely essential components of the cabinet. Retrofitting of the rails is impossible. The groove of the top rail is only accessible for the sliding rail from below, that of the bottom rail is only accessible from the top. Consequently, any exchangeability of the rails in their function as top rail or bottom rail is not achieved.

The Utility Model DE 203 03 045 U1 describes a structural unit for guiding sliding doors, which is fitted with an upper and a lower positionally fixed guide rail. The upper guide rail has two grooves which are arranged parallel to one another and open towards the bottom, in which the upper ends of the sliding doors are directly slidingly mounted. The lower guide rail has two elongate elevations arranged parallel to one another, on which the lower ends of the sliding doors stand indirectly displaceably, i.e. through interposed rollers. As a result of the design-dependent difference of the guide rails, it is not possible to use the upper guide rails as lower guide rail and vice versa so that their universal use is out of the question.

The Unexamined Laid-Open Patent Application DE 102 20 286 A1 discloses a running rail arrangement for sliding doors, where a fastening region for fastening the running rail arrangement to the front side of a cupboard is disposed laterally adjacent to a guide region configured as grooves for guiding the sliding doors, so that the running rail arrangement is suitable in principle for subsequent fastening to a cupboard. The guide region comprises an upper running rail, which has only grooves open towards the bottom and a lower running rail which only has grooves open towards the top. A universal use of the running rails is therefore out of the question.

SUMMARY OF THE INVENTION

The problem of a subsequent fitting with sliding doors arises rarely with cupboards but very frequently with shelves. Shelves offer an open storage space with respect to the surroundings where a requirement for subsequent delimitation of the storage space with respect to the surroundings can arise, for example, in order to protect the objects located in the storage space from negative environmental influences such as, for example, dust or ultraviolet radiation.

It is therefore the object of the present invention to provide a guide device for sliding doors for shelves which can be used universally and can be fastened subsequently to shelves.

In order to solve this object, the invention proposes a guide device of the type mentioned initially where the fastening arrangement is disposed relative to the guide arrangement in the installed position in such a manner that the guide arrangement is accessible from below and above for sliding doors and at least partially covers vertical surfaces of shelves. Accessibility in the sense of the invention comprises direct or indirect accessibility. Direct accessibility can, for example, mean a direct guidance of the sliding door frame or leaf, indirect accessibility can mean a guidance of rollers or running gear which are disposed operatively between the sliding door and the guide arrangement. The guide arrangement according to the invention comprises a multiple guide arrangement oriented in at least two different, preferably opposite directions and can therefore be used very advantageously for guidance of both upper and lower ends of sliding doors. Furthermore, the guide arrangement according to the invention with its arrangement between sliding doors spaced apart vertically with respect to one another allows a simultaneous guidance of the upper ends of lower sliding doors and the lower ends of upper sliding doors arranged thereabove. The guide arrangement according to the invention is consequently universally applicable. In the installed position the fastening arrangement according to the invention is disposed laterally adjacent to the guide arrangement. Consequently it does not restrict the accessibility to the guide arrangement for sliding doors from below and above and is oriented in the direction of the front side of shelves. The front side of shelves is always accessible, even in the already constructed state. Consequently, the guide device according to the invention can also be fastened subsequently to shelves. In general, the guide device can comprise a plurality of, in particular, two guide rails wherein one guide rail is disposed at an upper edge of the vertical surface and the other is disposed at a lower edge of the same vertical surface. In their interplay the two guide rails form a common guide arrangement and a common fastening arrangement.

In a particularly advantageous embodiment of the invention, the guide device comprises only one single guide rail, whose guide region and fastening region are each identical to the guide arrangement or fastening arrangement of the guide device. A single component very advantageously provides a guide arrangement which is accessible for sliding doors both from below and from above and thus fulfils a double function which is reflected in a reduced number of components required overall for a subsequent cladding of a shelf.

In one embodiment of the invention, it is provided that the guide arrangement in the installed position has at least one groove which is open towards the bottom for receiving upper ends of sliding doors and at least one groove which is open towards the top for receiving lower ends of sliding doors. This constructively simple but very efficient and successfully used geometry for guiding sliding doors enables the guide device according to the invention to be manufactured inexpensively, for example, of aluminium, steel or plastic by means of extrusion moulding, cold roll forming or extrusion, without requiring further mechanical or even electrical components. The said methods of manufacture allow a dimensioning of the guide device as required.

It has proved particularly advantageous that the groove which is open towards the bottom is deeper than the groove which is open towards the top. An arrangement of two guide devices according to the invention which guide at least one sliding door at the bottom and top satisfies the condition which is easy to achieve in practice: total of the clear distance of the guide rails and depth of the groove which is open towards the top less than or equal to the height of the sliding door less than or equal to the total of clear distance of the guide rails and depth of the groove which is open towards the bottom. All arrangements which satisfy this condition allow a subsequent insertion and removal of the sliding door over the longitudinal sides of the guide devices. This possibility according to the invention for the insertion and removal of the sliding door always exists whereas a standard insertion of the sliding door over the front sides of the guide devices is only possible when these are not yet installed or clad. For insertion into the arrangement of the guide devices, the sliding door is initially inserted on the longitudinal side of the lower guide device along upwards into the groove of the upper guide device which is open towards the bottom. After the sliding door rests on the base of the groove which is open towards the bottom, the sliding door is pivoted about its upper edge in such a manner that with its lower edge it is directly opposite the groove of the lower guide device which is open towards the top. The sliding door is finally lowered into the groove of the lower guide device which is open towards the top. In this lowered state, which forms the final installed state, the sliding door is guided by both guide devices and cannot come out unintentionally. For removal of the sliding door the aforesaid steps should be carried out in reverse order. It is also very advantageous that all the steps can be carried out without the assistance of a tool.

In a particularly advantageous embodiment of the invention, it is provided that the groove which is open towards the top has at least one elevation which tapers towards the top on its base. This elevation reduces the friction between the base of the groove and the sliding door so that the latter can be displaced with a reduced expenditure of force. According to the invention, the elevation can, for example, be half-oval or polygonal shaped in cross-section, in particular semicircular or triangular. With regard to the longitudinal elevation it is feasible that the elevation extends continuously, in discrete sections or point by point along the base of the groove of the guide device which is open towards the top. In the former case, a linear abutment of the sliding door on the elevation exists. The invention naturally also covers the case that the groove which is open towards the bottom has at least one elevation which tapers towards the bottom.

In order to provide a guide device which enables a complete cladding of a shelf with sliding doors and does not project over the lateral boundaries of the shelf for opening the sliding doors, it is very advantageously provided according to the invention that the guide region in the installed position has at least two grooves which are arranged parallel to one another and which are open towards the bottom, for receiving upper ends of sliding doors and at least two grooves which are arranged parallel to one another and which are open towards the top for receiving lower ends of sliding doors, since at least one sliding door can thus be arranged in each case in the groove near the shelf and the groove remote from the shelf, which merely covers a fraction of the total width of the shelf indirectly proportional to the number of all the sliding doors.

In one embodiment of the invention it further proves to be advantageous that the grooves which are open towards the bottom are disposed directly adjacent to one another and/or the grooves which are open towards the top are disposed directly adjacent to one another. It is best if adjacent grooves divide the wall located between them. As a result, a particularly close position of one sliding door near the shelf and one sliding door remote from the shelf can be achieved so that the sliding doors approximately seamlessly cover the shelf at its front side without leaving any noticeable through gap between them.

In order to preserve this advantage over a shelf having a plurality of sliding door stages, it is provided according to the invention that the grooves which are open towards the bottom and the grooves which are open towards the top are each disposed directly adjacent to one another and the grooves which are open towards the bottom and the grooves which are open towards the top are disposed directly opposite one another. In extreme cases the opposite grooves divide the base arranged between them. In addition, this arrangement of the grooves results in a particularly compact design of the guide devices, whereby these spread out less on the otherwise exposed front face of the shelf.

In an advantageous further development of the invention, it is provided that at least one of the grooves which is open towards the bottom has two contact surfaces parallel to the groove base. By providing such contact surfaces, a groove block or a carriage can be guided in the groove, on which for its part, for example, a textile or laminate curtain can be fastened. As a result, the type of door which can be used with the invention is extended from stable sliding doors to flexible materials.

It proves to be particularly advantageous that the fastening arrangement comprises form elements for subsequent fastening of the guide device to shelves. The guide devices and therefore sliding doors can thus be attached to already existing shelves and the shelves subsequently closed. Some particularly practical embodiments of form elements are described hereinafter, which ensure the highest possible compatibility between the guide arrangement according to the invention and the manifold-shaped components for shelves. The invention is naturally not restricted to the following form elements but comprises all form elements which are equivalent to the embodiments actually described. A first embodiment is very advantageously characterised in that the form elements are configured as C-shaped clips for clipping around components for shelves ending in a T-shape or adapter parts ending in a T-shape. The guide device can thus be clipped on subsequently by hand without requiring the use of tools. In an alternative embodiment of the invention, it is provided that the form elements are configured as T-shaped fitting pieces for engaging in components for shelves ending in a C-shape or in adapter parts ending in a C-shape. This inverted embodiment of the invention with respect to the previously described embodiment can, for example, very advantageously be arranged on a universally applicable construction profile of the applicant, which is described for example, in DE 10 2008 006 439 A1 and with said construction profile forms a functional group of components for shelves, scaffolds or trade fair stands. A further embodiment is very advantageously characterised in that the form elements are configured as L-shaped stops for fastening to plate-like components for shelves. The connection between the L-shaped stops and the plate-like components can be configured to be positive, non-positive or seamless depending on the material of the plate-like components. Screwing and gluing are types of connection particularly relevant in practice. In another advantageous embodiment of the invention it is provided that the form elements are configured as through holes for front-side fastening to plate-like components for shelves. This embodiment is constructively the simplest to execute and is very flat so that the space requirement for the arrangement of the guide device on the exposed front side of shelves is reduced to a minimum. In a further embodiment of the invention it is very advantageously provided that the form elements are configured as U-shaped receiving pockets with two substantially parallel legs for fastening to plate-like components for shelves. Through advantageous choice of the clear width of the parallel legs relative to a thickness of the plate-like components, this embodiment enables a firm clamping of the form elements to the plate-like components. Optionally other, in particular positive or seamless types of connection can be used for securing the non-positive connection. The U-shaped receiving pockets largely enclose the ends of the plate-like components so that the guide device contributes to an appreciable stabilisation of the plate-like components. In other words, due to the subsequent application of the guide devices, the actual load-bearing capacity of the shelves of the shelving systems is increased significantly. Alternatively to this, larger clear widths can be achieved between two adjacent support elements of the shelves. By enclosing the frequently delicate and not very resistant plate-like components by means of the U-shaped receiving pockets, the front-side edges of the plate-like components are best protected from mechanical wear. The U-shaped receiving pockets therefore provide excellent edge protection. This also applies to the L-shaped stops.

In order to further increase the compatibility of the guide device according to the invention with most diverse components for shelves, it is provided that depending on the predefined geometry of the components for shelves, the legs are configured as one long leg and one short leg, wherein the short leg at its free end is configured to be bent at right angles in the direction of the long leg.

In addition, it proves to be particularly advantageous according to the invention if the at least one leg is configured to be sloping at an outwardly pointing edge of its free end. In the event that the leg in question is disposed on an upper side of a shelf of a shelving system, its slope makes it considerably easier to pull out objects stored in the shelf without lifting. Furthermore a sloped edge provides less room for the collection of dirt and dust.

In an alternative embodiment of the invention, it is very advantageously provided that the guide device comprises adapter parts, in particular adapter parts ending in a T shape or C shape, as can be required for the universal fastening to the components for shelves discussed above.

It proves to be particularly advantageous according to the invention that the form elements and/or the adapter parts are disposed continuously or in discrete sections along the guide device depending on the required strength of the connection between the guide device and the components for shelves or the required load-bearing capacity of the shelf boards.

An arrangement of at least two guide rails for sliding doors for shelves has proved to be very advantageous where the guide rails are vertically spaced apart from one another in pairs and configured according to the present invention. In addition, the arrangement allows a modular and therefore basically infinitely extendable structure for subsequent cladding of shelves with sliding doors.

The guide device according to the invention can be disposed on horizontal and vertical components for shelves both horizontally and vertically. Along with its main function, the guidance of sliding doors and stabilization of shelves, it is provided that the guide rail serves as a panel or for edging rear walls for shelves.

BRIEF DESCRIPTION OF THE DRAWINGS

The invention is described in a preferred embodiment with reference to the drawings as an example, where further advantageous details can be deduced from the figures of the drawings.

The figures in the drawings show in detail.

DESCRIPTION OF THE PREFERRED EMBODIMENTS

Figure 1:
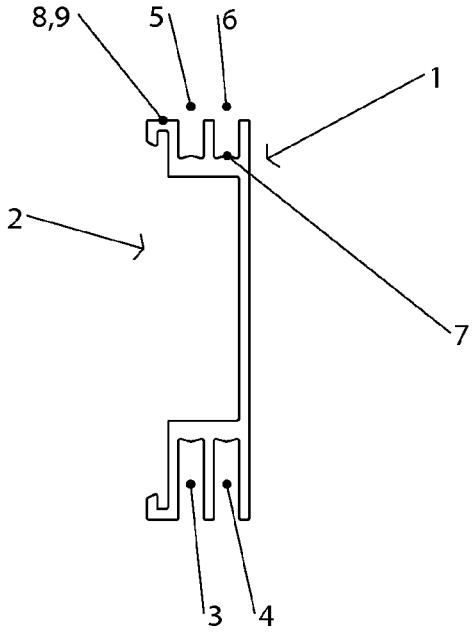
FIG. 1 shows a profile view of the guide device with a fastening arrangement configured as a C-shaped clip.

FIG. 1 shows a profile view of the guide device with a fastening arrangement 2 configured as a C-shaped clip 9. The C-shaped clip 9 as form element 8 of the fastening arrangement 2 is used for clipping around components for shelves ending in a T-shape or adapter parts ending in a T-shape and extends continuously along the guide rail. For guiding sliding doors the guide arrangement 1 connected to the fastening arrangement 2 has two grooves 3, 4 which are arranged parallel to one another and which are open towards the bottom for receiving upper ends of sliding doors and two grooves 5, 6 which are arranged parallel to one another and which are open towards the top for receiving lower ends of sliding doors. In the installed position the grooves 3, 4 which are open towards the bottom are disposed perpendicularly below the grooves 5, 6 which are open towards the top. The grooves 3, 4 which are open towards the bottom are deeper than the grooves 5, 6 which are open towards the top, where in this embodiment all the grooves 3 to 6 comprise elevations 7 at their bases. The elevations 7 have a triangular cross-section and extend continuously along the guide device. A vertical web connects the grooves 3, 4 which are open towards the bottom to the grooves 5, 6 which are open towards the top. Its thickness is significantly less than the uniform width of the grooves 3 to 6 in order to achieve a certain flexibility of the guide device for subsequent clipping onto components for shelves ending in a T-shape or adapter parts ending in a T-shape. The edges of the C-shaped clip 9 which initially impinge upon a component ending in a T-shape or adapter parts during the subsequent clipping on are sloping in order to facilitate the clipping on. The edges of the clip 9 ending in a C-shape which should ensure a permanent and load-bearing engagement in a component ending in a T-shape after clipping-on are logically not sloping.

Figure 2:
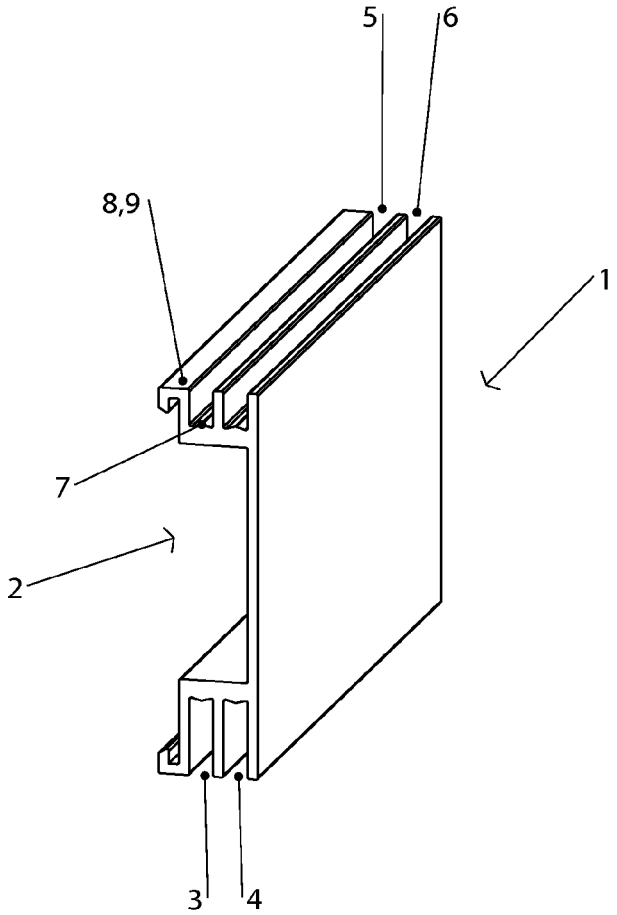
FIG. 2 shows a perspective view of the guide device with a fastening arrangement configured as a C-shaped clip.

FIG. 2 shows a perspective view of the guide device with a fastening arrangement 2 configured as a C-shaped clip 9. As can easily be identified, the guide device has a homogeneous profile along its course.

Figure 3:
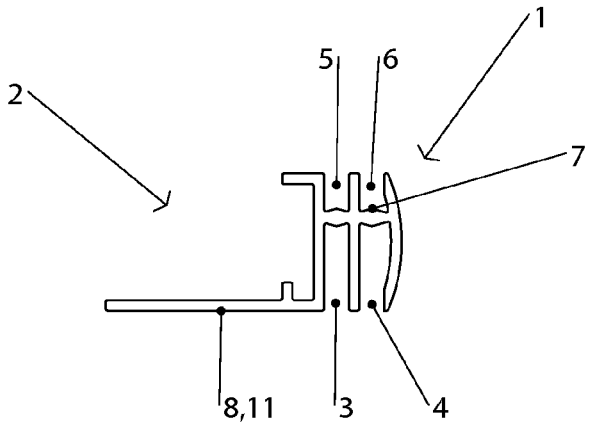
FIG. 3 shows a profile view of the guide device with a fastening arrangement configured as an L-shaped stop.

FIG. 3 shows a profile view of the guide device with a fastening arrangement 2 configured as an L-shaped stop 11. The L-shaped stop 11 as form element 8 of the fastening arrangement 2 is used for fastening to plate-like components for shelves such as, for example, panels or adapter parts ending in a T shape and extends continuously along the guide device. The L-shaped stop 11 shown has two spacer plate-like components. The guide arrangement 1 comprises two grooves 3, 4 which are open towards the bottom and which are arranged parallel to one another for receiving upper ends of sliding doors and two grooves 5, 6 which are open towards the top and which are arranged parallel to one another for receiving lower ends of sliding doors. The grooves 3, 4 which are open towards the bottom and the grooves 5, 6 which are open towards the top are each arranged directly adjacent to one another and the pairs of grooves 3, 4 or 5, 6 thus formed are directly opposite one another. The grooves 4, 6 facing away from the fastening arrangement 2 are configured to be bulbous towards their bases.

Figure 4:
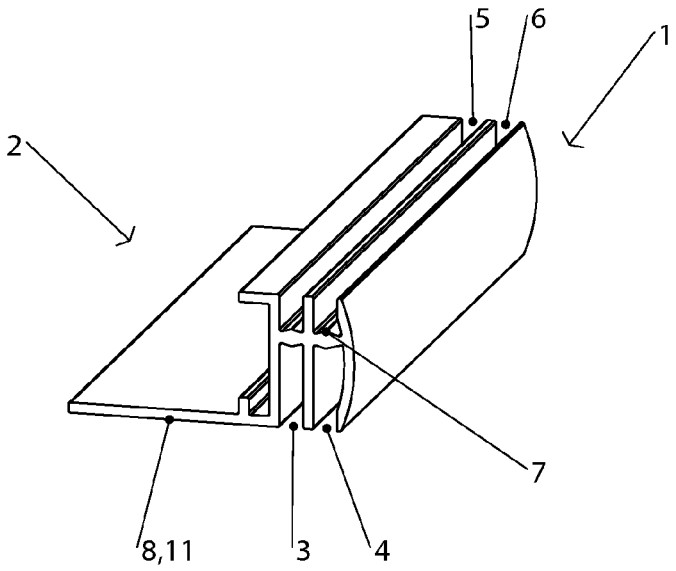
FIG. 4 shows a perspective view of the guide device with a fastening arrangement configured as an L-shaped stop.

FIG. 4 shows a perspective view of the guide device with a fastening arrangement 2 configured as an L-shaped stop 11, where here again the translational invariance of the guide device along its course can be identified.

Figure 5:
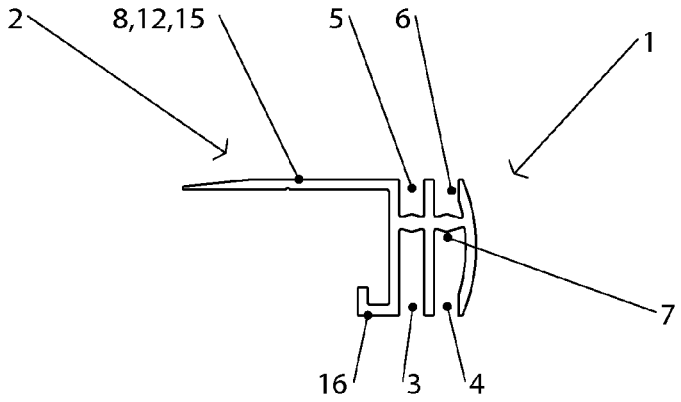
FIG. 5 shows a profile view of the guide device with a fastening arrangement configured as a U-shaped receiving pocket with a bent short leg.

FIG. 5 shows a profile view of the guide device with a fastening arrangement 2 configured as a U-shaped receiving pocket 12 with a bent short leg 16. This configuration of the form elements 8 enables a combined fastening on plate-like components for shelves on the one hand or clipping around components for shelves ending in a T-shape or adapter parts ending in a T-shape on the other hand. The guide arrangement 1 is configured similarly to the guide arrangement 1 shown in FIG. 3. The straight long leg 15 of the U-shaped receiving pocket 12 is configured to be sloping on the outward-pointing edge of its free end and has an alignment groove on its inwards-oriented side.

Figure 6:
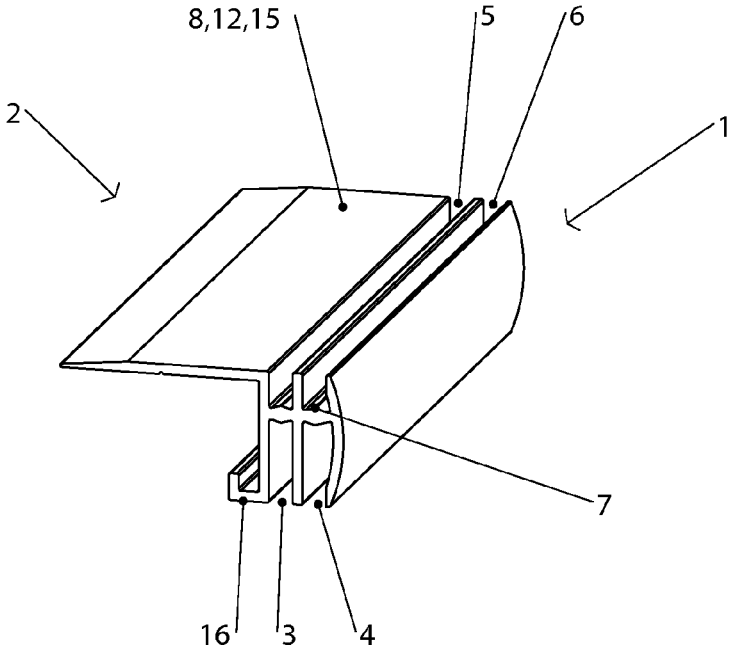
FIG. 6 shows a perspective view of the guide device with a fastening arrangement configured as a U-shaped receiving pocket with a bent short leg.

FIG. 6 shows a perspective view of the guide device with a fastening arrangement 2 configured as a U-shaped receiving pocket 12 with a bent short leg 16. The slope of the straight long leg 15 on the outwardly pointing edge of its free end can be clearly seen. This makes it considerably easier to pull out items stored in the shelf without lifting. Furthermore a sloped edge provides less room for the collection of dirt and dust.

Figure 7:
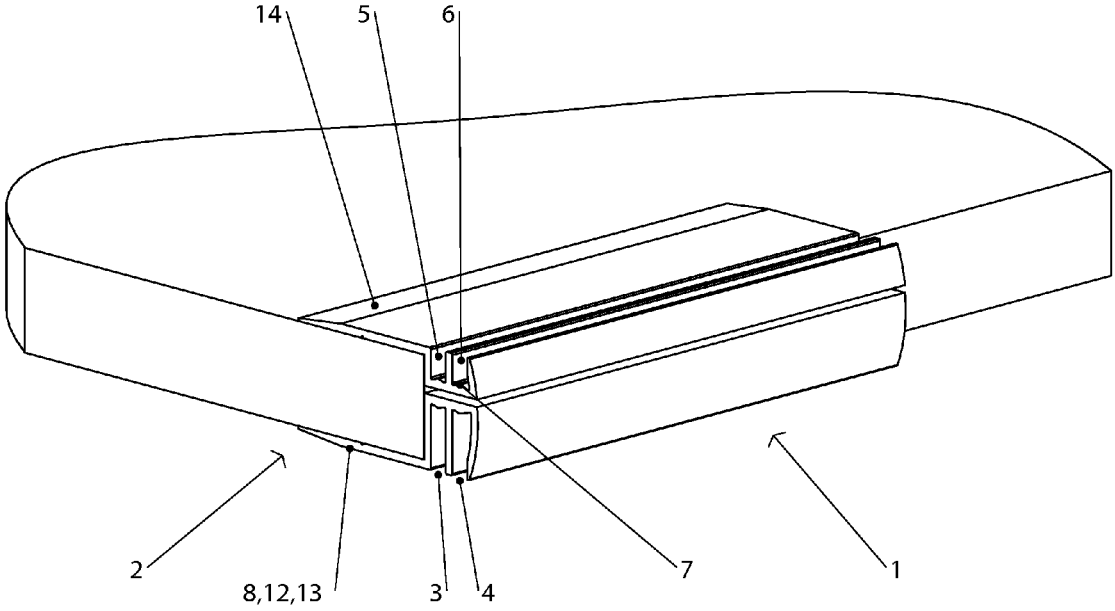
FIG. 7 shows a perspective view of the guide device with a fastening arrangement configured as a U-shaped receiving pocket.

FIG. 7 shows a perspective view of the guide device with a fastening arrangement 2 configured as a U-shaped receiving pocket 12. The U-shaped receiving pocket 12 as form element 8 comprises two parallel legs 13, 14 and is used for fastening, in particular clamping, plate-like components for shelves. The guide arrangement 1 comprises two grooves 3, 4 which are open towards the bottom and which are arranged parallel to one another for receiving upper ends of sliding doors and two grooves 5, 6 which are open towards the top and which are arranged parallel to one another for receiving lower ends of sliding doors. The grooves 3, 4 which are open towards the bottom and the grooves 5, 6 which are open towards the top are each arranged directly adjacent to one another and the pairs of grooves 3, 4 or 5, 6 thus formed are directly opposite one another. The two groove pairs 3, 4 and 5, 6 are interconnected by means of a web which is set back and therefore not visible. In an alternative embodiment of the invention this web is not provided and the guide device according to the invention consists of two guide rails, i.e. one with grooves 3, 4 which are open towards the bottom and one with grooves 5, 6 which are open towards the top. In contrast to a guide device with a single guide rail and a U-shaped receiving pocket 12, the two guide rails of the alternative guide device each have an L-shaped stop.

Figure 8:
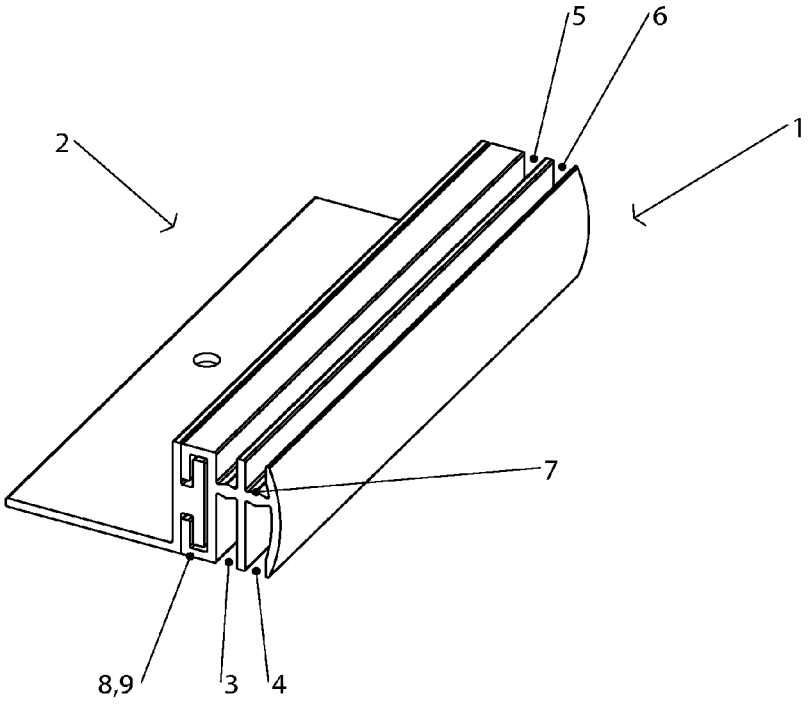
FIG. 8 shows a perspective view of the guide device with a fastening arrangement configured as a C-shaped clip and a continuously running adapter part ending in a T-shape.

FIG. 8 shows a perspective view of the guide device with a fastening arrangement 2 configured as a C-shaped clip 9 and a continuously running adapter part ending in a T-shape. The guide arrangement 1 shown here is configured to be double-flight. Single- and multiple-flight guide arrangements 1 are naturally also possible according to the invention. The adapter part has through holes for fastening to plate-like components for shelves which can have securing means, for example, screws, passing through them.

Figure 9:
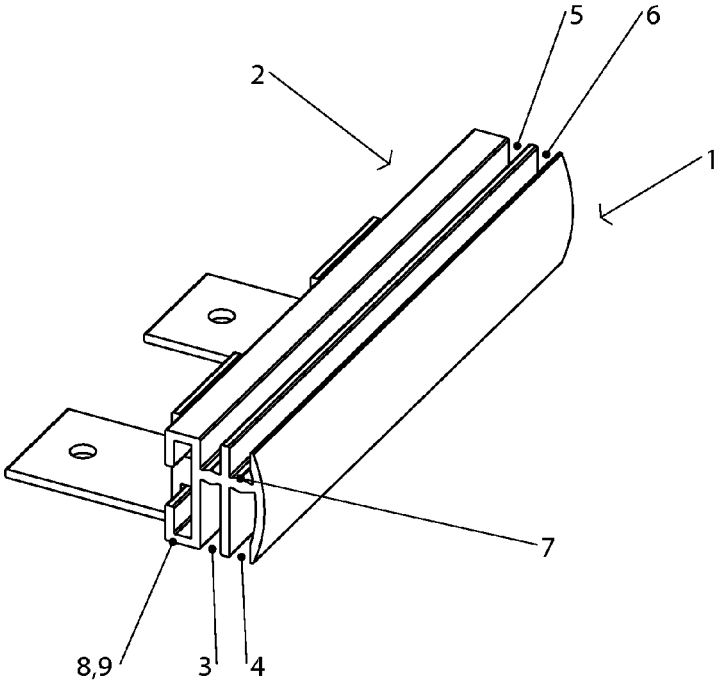
FIG. 9 shows a perspective view of the guide device with a fastening arrangement configured as a C-shaped clip and an adapter part arranged in discrete sections and ending in a T-shape.

FIG. 9 shows a perspective view of the guide device with a fastening arrangement 2 configured as a C-shaped clip 9 and adapter parts arranged in discrete sections and ending in a T-shape. These adapter parts, which are reduced in their length compared with the length of the guide device, have holes.

Figure 10:
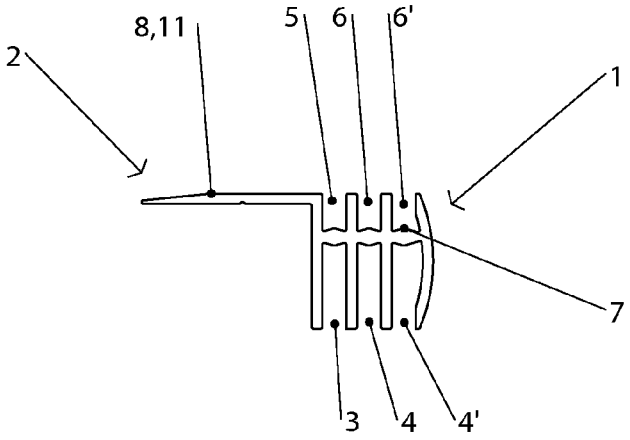
FIG. 10 shows a profile view of the guide device with a fastening arrangement configured as an L-shaped stop.

FIG. 10 shows a profile view of the guide device with a fastening arrangement 2 configured as an L-shaped stop 11. The L-shaped stop 11 as form element 8 allows a fastening to plate-like components for shelves. The outwardly pointing edge of the free end of the L-shaped stop 11 is sloping. In this embodiment the guide arrangement 1 is configured as three-flight.

Figure 11:
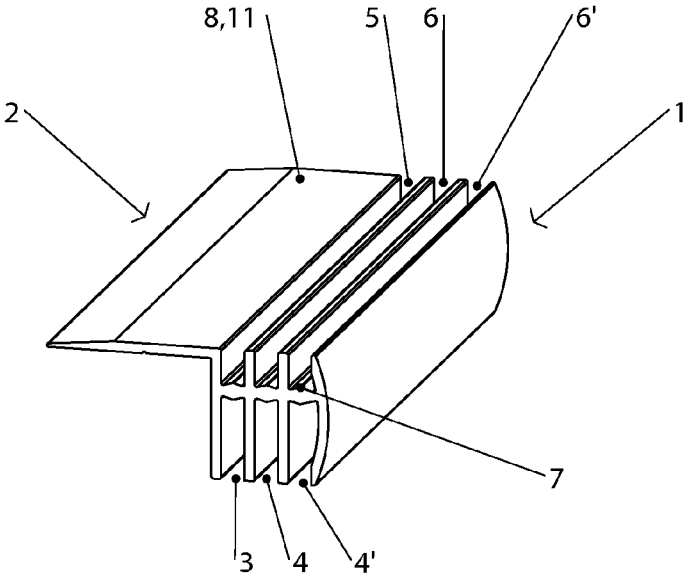
FIG. 11 shows a perspective view of the guide device with a fastening arrangement configured as an L-shaped stop.

FIG. 11 shows a perspective view of the guide device with a fastening arrangement 2 configured as an L-shaped stop 11. It can easily be seen that the guide device has a homogeneous profile along its course.

Figure 12:
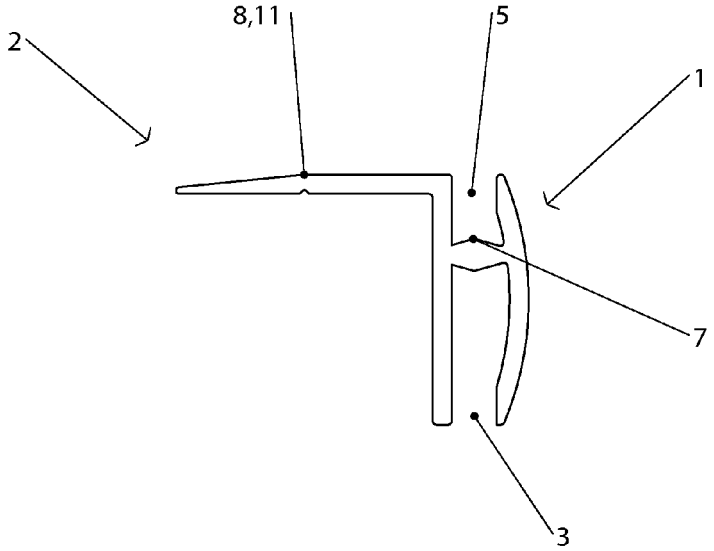
FIG. 12 shows a profile view of the guide device with a fastening arrangement configured as an L-shaped stop.

FIG. 12 shows a profile view of the guide device with a fastening arrangement 2 configured as an L-shaped stop 11, where the guide arrangement 1 is configured here as single-flight. This configuration embodies the constructively simplest version of the guide device according to the invention. Otherwise, this embodiment is identical to the embodiment shown in FIG. 10.

Figure 13:
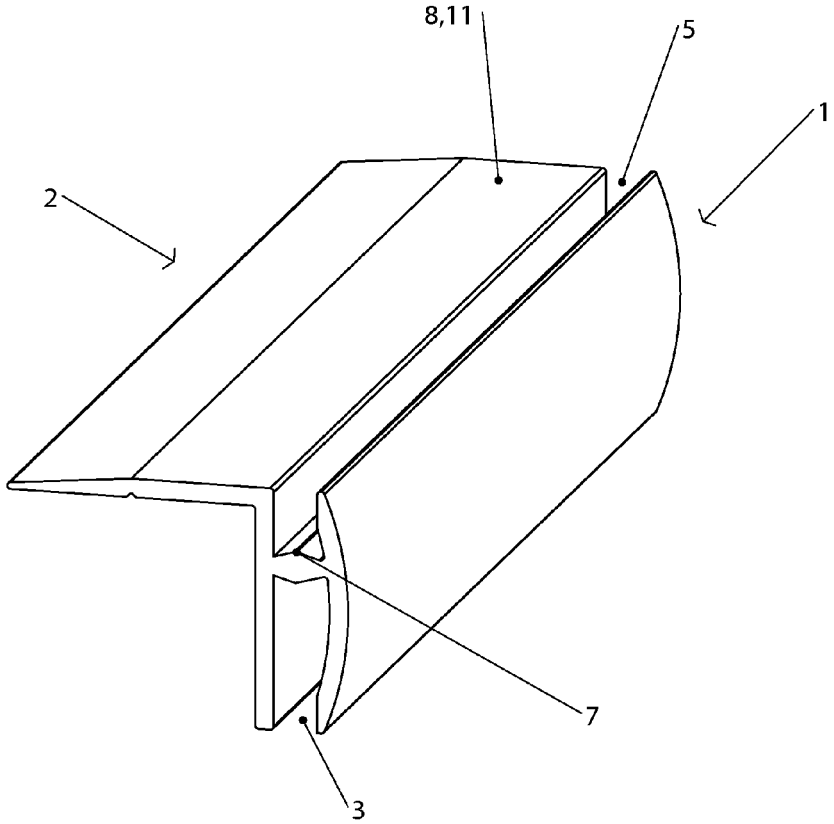
FIG. 13 shows a perspective view of the guide device with a fastening arrangement configured as an L-shaped stop.

FIG. 13 shows a perspective view of the guide device with a fastening arrangement 2 configured as an L-shaped stop 11. That stated for FIG. 11 also applies here.

Figure 14:
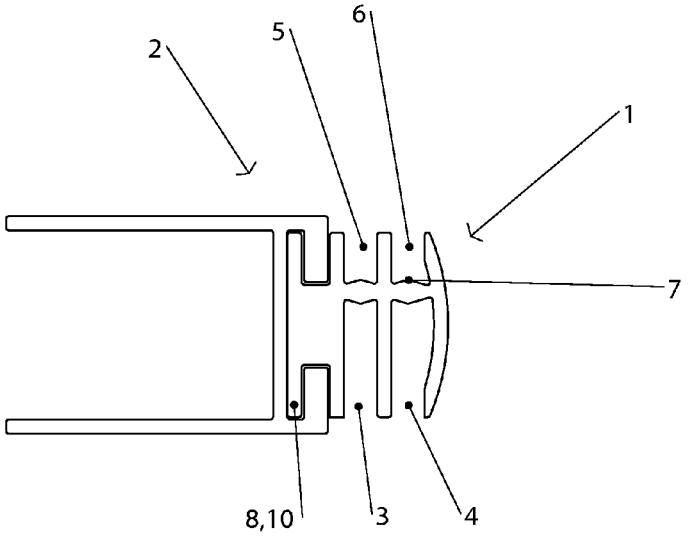
FIG. 14 shows a profile view of the guide device with a fastening arrangement configured as a T-shaped fitting piece and an adapter part ending in a C-shape.

FIG. 14 shows a profile view of the guide device with a fastening arrangement 2 configured as a T-shaped fitting piece 10 and an adapter part ending in a C-shape. The T-shaped fitting piece 10 as form element 8 allows engagement into components for shelves ending in a C shape or in adapter parts ending in a C shape, as shown here. The guide arrangement 1 comprises two grooves 3, 4 which are open towards the bottom and which are arranged parallel to one another for receiving upper ends of sliding doors and two grooves 5, 6 which are open towards the top and which are arranged parallel to one another for receiving lower ends of sliding doors. The grooves 3, 4 which are open towards the bottom and the grooves 5, 6 which are open towards the top are each arranged directly adjacent to one another and the pairs of grooves 3, 4 or 5, 6 thus formed are directly opposite one another. The adapter part ending in a C shape extends continuously along the guide device and at the end facing away from the C-shaped end, has a U-shaped receiving pocket with two substantially parallel legs.

Figure 15:
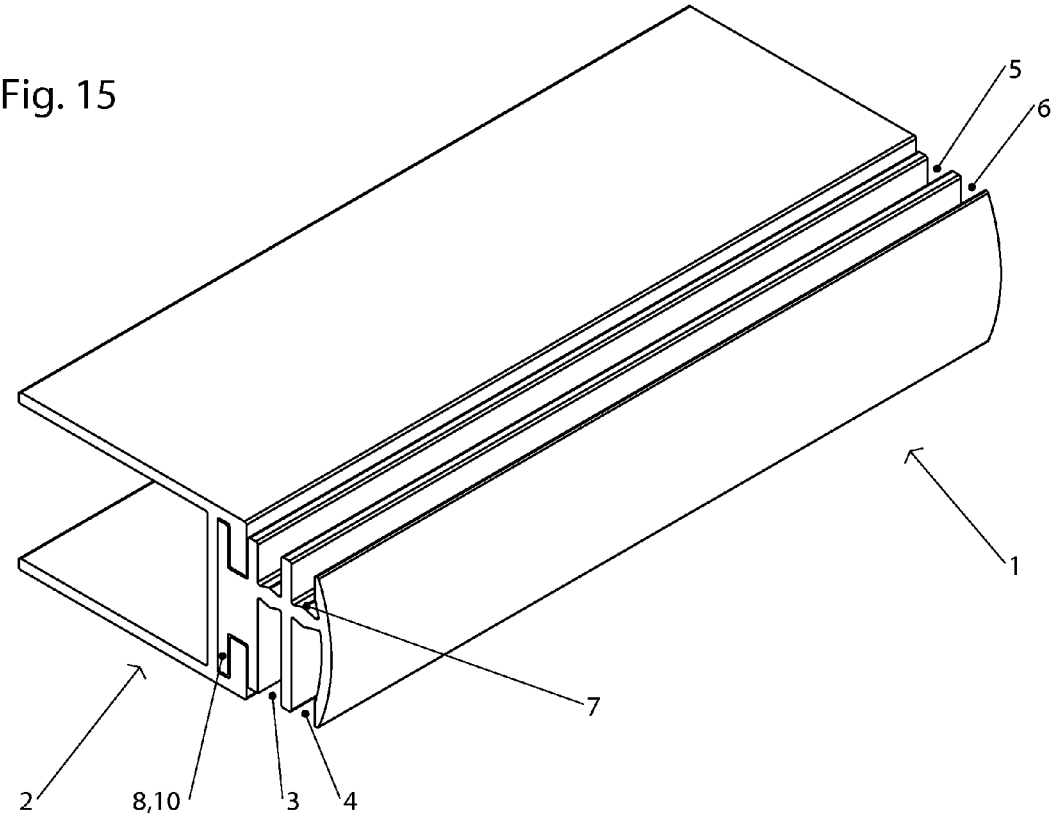
FIG. 15 shows a perspective view of the guide device with a fastening arrangement configured as a T-shaped fitting piece and an adapter part ending in a C-shape.

FIG. 15 shows a perspective view of the guide device with a fastening arrangement 2 configured as a T-shaped fitting piece 10 and an adapter part ending in a C-shape. The guide device has a homogeneous profile. Next to the T-shaped fitting piece 10, the adapter part also extends continuously along the guide device.

Figure 16:
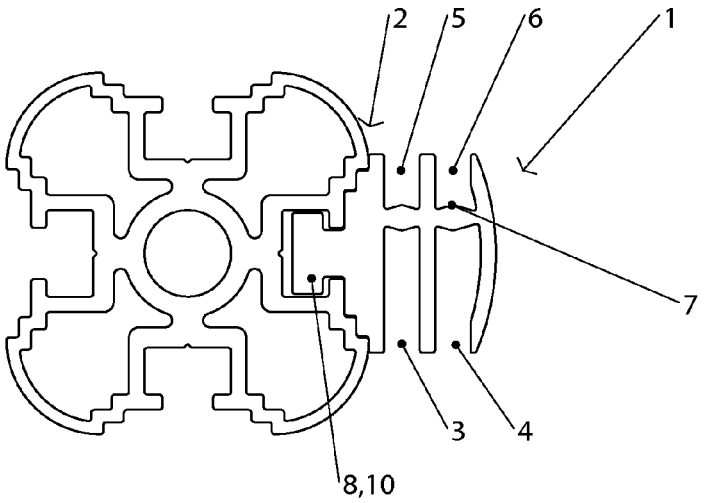
FIG. 16 shows a profile view of the guide device with a fastening arrangement configured as a T-shaped fitting piece.

FIG. 16 shows a profile view of the guide device with a fastening arrangement 2 configured as a T-shaped fitting piece 10. In the special embodiment shown here a base configured in a staircase shape on both sides is provided in the foot region of the T-shaped fitting piece 10 in order to achieve an optimal tight fit to the construction profile of the applicant which is described, for example, in the Unexamined Laid-Open Patent Application DE 10 2008 006 439 A1. The T-shaped fitting piece 10 functions as a precisely fitting groove block in the C-shaped groove of the construction profile. Consequently maximally stable shelves, scaffolds or trade fair stands can be achieved.

Figure 17:
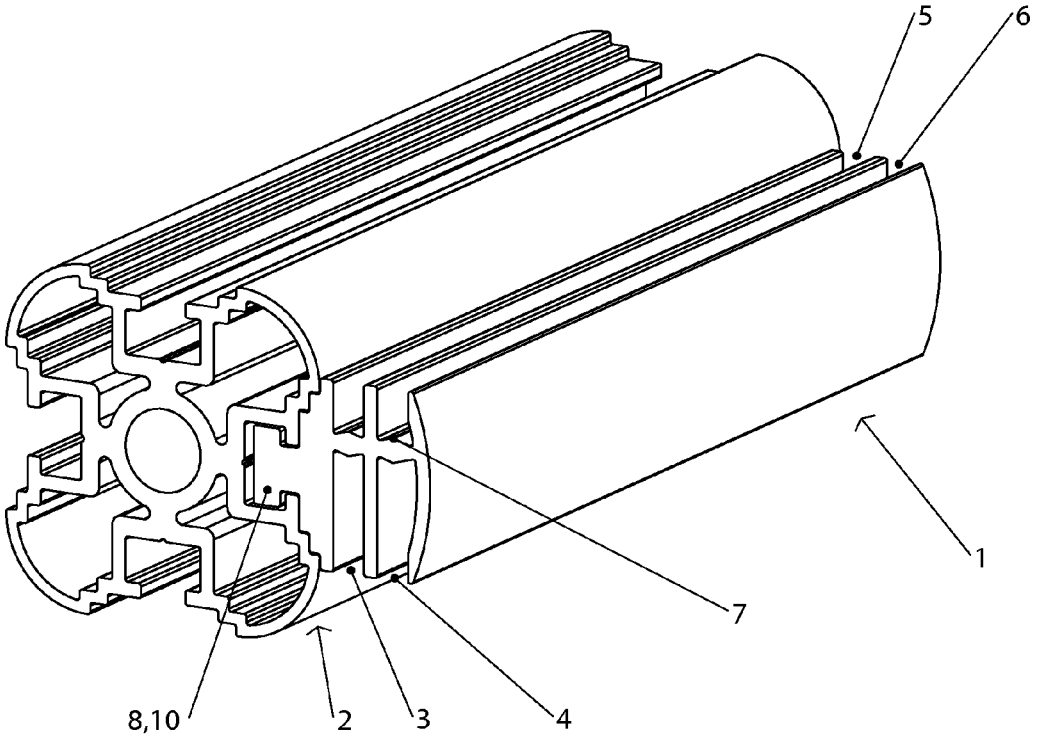
FIG. 17 shows a perspective view of the guide device with a fastening arrangement configured as a T-shaped fitting piece.

FIG. 17 shows a perspective view of the guide device with a fastening arrangement 2 configured as a T-shaped fitting piece 10. The T-shaped fitting piece 10 is configured to run continuously along the guide device. Naturally a sectional arrangement of the T-shaped fitting piece 10 would also be feasible.

Figure 18:
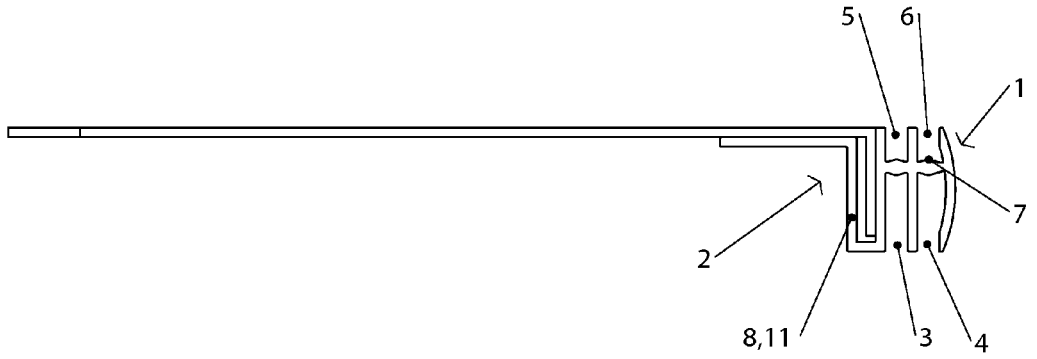
FIG. 18 shows a profile view of the guide device with a fastening arrangement configured as an L-shaped stop.

FIG. 18 shows a profile view of the guide device with a fastening arrangement 2 configured as an L-shaped stop 11. The L-shaped stop 11 comprises an angularly shaped loop disposed between the actual stop region and the guide region for receiving bent ends of panels ending in a bent manner, in particular tin shelves such as are found in simply held shelving systems for workshops and garages.

Figure 19:
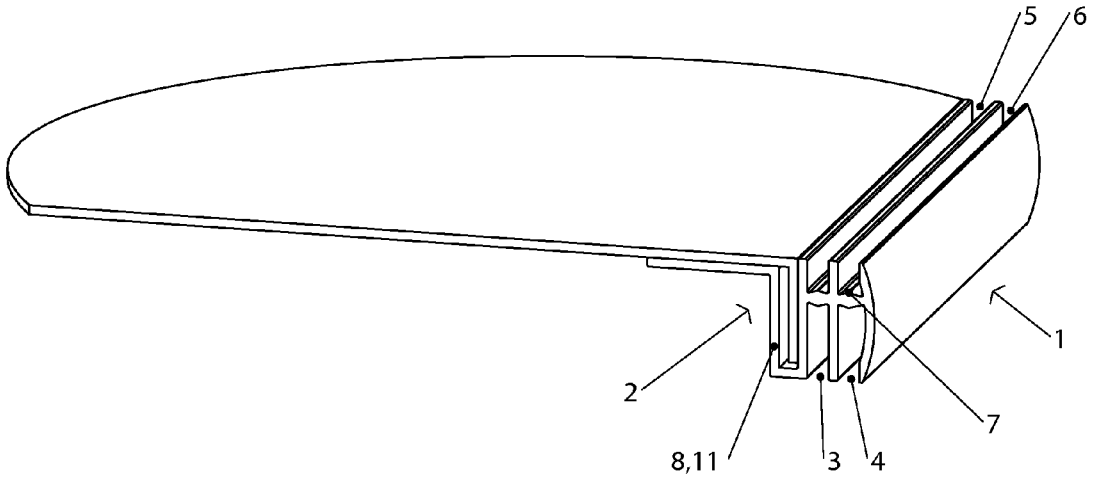
FIG. 19 shows a perspective view of the guide device with a fastening arrangement configured as an L-shaped stop and FIG. 20 shows a perspective view of the guide device with a fastening arrangement configured as a bore.

FIG. 19 shows a perspective view of the guide device with a fastening arrangement 2 configured as an L-shaped stop 11, where the L-shaped stop 11 comprises an angularly shaped loop disposed between the actual stop region and the guide region. The guide device shows a translationally invariant profile.

Figure 20:
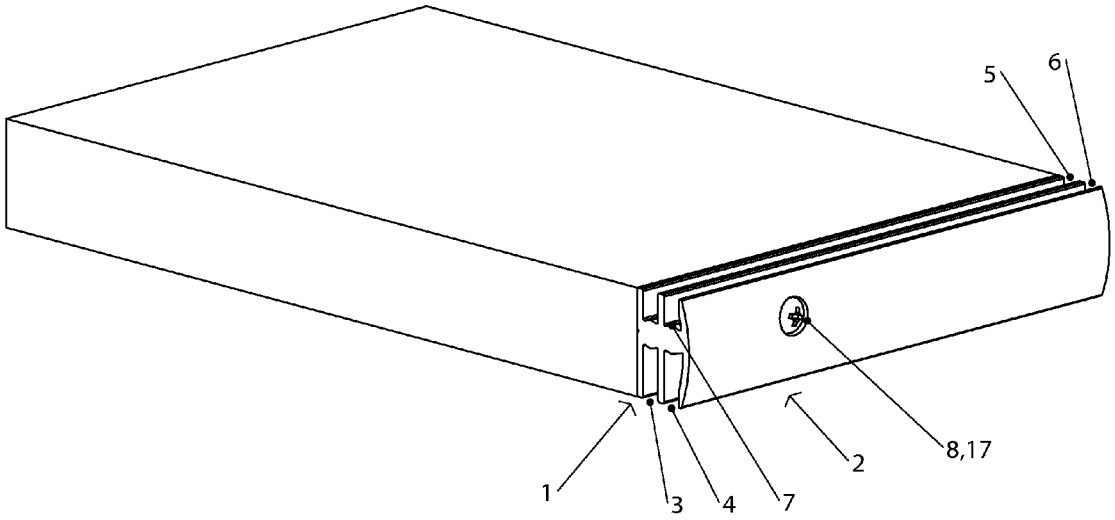

FIG. 20 shows a perspective view of the guide device with a fastening arrangement 2 configured as a through hole 17. The through holes 17 as form element 8 are disposed between the grooves 3, 4 which are open towards the bottom and the grooves 5, 6 which are open towards the top and allow a front-side fastening to plate-like components for shelves or other solid components by means of additional securing means such as, for example, screws. In a preferred embodiment of the invention the through holes 17 are configured as recessed at their ends which are visible in the installed position so that the heads of screwed-in fastening screws do not project from the slightly bent cover surface of the guide arrangement 1 which is configured to be panel-like and is visible in the installed position.

Figure 21:
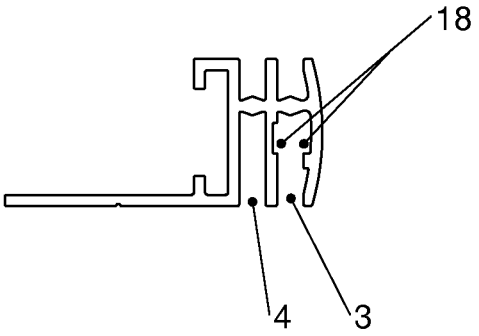
FIG. 21 finally shows a perspective profile view of a suitable embodiment for carriages and textile sliding doors.

FIG. 21 finally shows a perspective profile view of a suitable embodiment for carriages and textile sliding doors. The two contact surfaces 18 each arranged on the right and left of the groove opening parallel to the groove base plane can be clearly identified. One contact surface 18 which serves as a sliding surface for a carriage or groove block not shown is formed in the common walls of the two grooves 3, 4 which are open towards the bottom and which are arranged parallel to one another. This was accomplished here by means of a one-sided reduction in wall thickness so that a further groove extending in the longitudinal direction of the profile is obtained in the common wall of the two grooves 3, 4 which are open towards the bottom. The opposite contact surface is formed by a web which is formed on the bent outer wall directed inwards onto the first contact surface. Both contact surfaces 18 lie in a common plane. The position of the contact surfaces 18 in the groove depth is selected so that the springing-in lower end of the bent outer wall is aligned with the free end of the formed web. As a result, this embodiment very advantageously allows the alternative use of a sliding door and a carriage in the same profile since the web does not hinder the insertion of a sliding door. The groove width is expanded between contact surfaces 18 and groove base, in particular is expanded approximately at right angles in order to enable the sliding movement of a carriage or slider along the groove longitudinal axis. Fundamentally, it would also be possible according to the invention to provide the second inner groove which is open towards the bottom with such a contact surface so that two textile doors or lamellae can be provided guided by sliders. In the installed position of the guide device, the carriage or slider is inserted into the profile at the front.

REFERENCE LIST

1 Guide arrangement
2 Fastening arrangement
3 Groove which is open towards the bottom
4 Groove which is open towards the bottom
5 Groove which is open towards the top
6 Groove which is open towards the top
7 Elevation
8 Form element
9 Clip
10 Fitting piece
11 Stop
12 Receiving pocket
13 Leg
14 Leg
15 Long leg
16 Short leg
17 Through hole
18 Contact surface

What is claimed is:

1. A guide device for sliding doors for shelves, comprising:

at least one guide rail, wherein each guide rail comprises a guide region for guiding sliding doors, with each guide region comprising at least one groove (3,4,5,6), and each guide rail further comprises a fastening region connected to the guide region for fastening the guide device to shelves, wherein all the guide regions, including the grooves, collectively form a guide arrangement (1) and all the fastening regions in their cooperation form a fastening arrangement (2), wherein the guide device has an installed state where it is engaged to both a generally horizontal shelf and at least one generally vertical sliding door, and an uninstalled state where it is not engaged to a shelf or a sliding door, wherein the fastening arrangement (2) is disposed relative to the guide arrangement so that in the installed state at least one groove (5,6) opens upwards and is accessible for receiving sliding doors from above, at least one groove (3,4) opens downwards and is accessible for receiving sliding doors from below, and the fastening arrangement and shelf are lateral to the grooves, wherein in the installed state at least one vertical sliding door is positioned in at least one groove (3) of the guide arrangement, wherein in the installed state a fastening region is fixed next to a generally vertical front end surface of a horizontal shelf, wherein in the installed state the guide arrangement at least partially covers the front end surface of the shelf, and wherein in the installed state the guide arrangement (1), including the grooves (3,4,5,6), is disposed laterally adjacent to the fastening arrangement so that the guide arrangement (1) and grooves (3,4,5,6) are oriented out from and in front of the end of the shelf, wherein the fastening arrangement (2) comprises form elements (8) for fastening the guide device to shelves, and wherein the form elements (8) comprise C-shaped clips (9) for clipping around T-shaped shelf ends or T-shaped shelf adapter elements, and wherein said C-shaped clips (9) comprise a pair of generally vertical arms pointing towards each other.

2. The guide device according to claim 1, characterized in that at least one groove (3,4) which is open downwards in the installed state is deeper than at least one groove (5) which is open upwards in the installed state.

3. The guide device according to claim 1, characterized in that the groove (5) which is open upwards in the installed state has at least one elevation (7) which tapers towards the top on its base.

4. The guide device according to claim 1, characterized in that the guide arrangement (1) in the installed state has at least two grooves (3, 4) which are arranged parallel to one another and which open downwards for receiving upper ends of sliding doors, and at least two grooves (5, 6) which are arranged parallel to one another and which open upwards for receiving lower ends of sliding doors.

5. The guide device according to claim 4, characterized in that in the installed state the grooves (3, 4) which are open downwards are disposed directly adjacent to one another and/or the grooves (5, 6) which are open upwards are disposed directly adjacent to one another.

6. The guide device according to claim 4, characterized in that the grooves (3, 4) which are open downwards in the installed state and the grooves (5, 6) which are open upwards in the installed state are each disposed directly adjacent to one another, and wherein at least some of said grooves (3, 4) which are open downwards and said grooves (5, 6) which are open upwards open directly opposite one another.

7. The guide device according to claim 1, characterized in that in the installed state at least one of the grooves (3, 4) which opens downwards has two contact surfaces (18) parallel to the groove base.

8. A sliding door shelf arrangement comprising the guide device of claim 1, the arrangement comprising:

at least two horizontal shelves, including a high shelf and a low shelf;

a guide device according to claim 1 comprising at least two guide rails, including a high guide rail fixed to the high shelf and a low guide rail fixed to the low shelf, with the guide rails being fixed to end surfaces of their respective shelves by their respective fastening regions; and at least one vertical sliding door slidably positioned between the high and low guide rails;

wherein a top edge of the sliding door is positioned in a downward opening groove of the top guide rail, and wherein a bottom edge of the same sliding door is positioned in an upward opening groove of the bottom guide rail.

9. The sliding door shelf arrangement of claim 8:

wherein the high guide rail and low guide rail each comprise two grooves opening upwards and two grooves opening downwards; and wherein two vertical sliding doors are slidably positioned between the high and low guide rails, each sliding door being positioned in both a downward opening groove of the top guide rail and an upward opening groove of the bottom guide rail.

10. The sliding door shelf arrangement of claim 8, wherein the high guide rail and the low guide rail are substantially identical other than their locations.

11. The sliding door shelf arrangement of claim 8:

wherein the high guide rail comprises at least one upward opening groove, and that upward opening groove is uncovered and faces out away from the guide device; and wherein the low guide rail comprises at least one downward opening groove, and that downward opening groove is uncovered and faces out away from the guide device.

12. The guide device of claim 1, wherein the fastening arrangement and the guide arrangement are formed as a single piece of aluminum, steel, or plastic.

13. The guide device of claim 1, wherein the guide device comprises at least two guide rails which are substantially identical to one another.

14. The guide device according to claim 1, wherein the fastening arrangement (2) comprises form elements (8) which fasten the guide device to at least one shelf in the installed state; and wherein the form elements (8) comprise one or more C-shaped clips (9) clipped around shelf end components having a T-shape, in the installed state.

15. A sliding door shelf arrangement comprising the guide device of claim 1, the arrangement comprising:

at least two horizontal shelves, including a high shelf and a low shelf, wherein at least part of the shelves comprise substantially flat tops, bottoms, and edges;

a guide device according to claim 1 comprising at least two guide rails, including a high guide rail fixed to the high shelf and a low guide rail fixed to the low shelf;

at least one adapter comprising two substantially parallel spaced apart legs, wherein the at least one adapter is engaged to an edge of at least one shelf by the two spaced apart legs, with a leg contacting the bottom of the shelf and a leg contacting the top of the shelf;

wherein the adapter further comprises a T-shaped shelf adapter element which is complimentary to at least one C-shaped clip form element (8) of at least one guide rail according to claim 1;

wherein at least one guide rail is fixed to a shelf by a C-shaped clip form element (8) of its fastening arrangement which is engaged to a complimentary T-shaped shelf adapter element;

the sliding door shelf arrangement further comprising at least one vertical sliding door slidably positioned between the high and low guide rails;

wherein a top edge of the sliding door is positioned in a downward opening groove of the top guide rail, and wherein a bottom edge of the same sliding door is positioned in an upward opening groove of the bottom guide rails.

16. The guide device of claim 1, wherein said C-shaped clips (9) for clipping around T-shaped shelf ends or T-shaped shelf adapter elements comprise a pair of vertical arms pointing towards each other;

wherein said vertical arms each comprise ends thereof;

wherein an outer side of each of said ends of said vertical arms is positioned to initially impinge upon a T-shaped component during clipping on of said C-shaped clips (9); and wherein at least one of said outer sides of each of said ends of said vertical arms is sloped in order to facilitate clipping on to T-shaped components.

17. The guide device of claim 1:

wherein said generally vertical arms pointing towards each other of said C-shaped clips (9) each comprise respective ends thereof; and wherein at least one of said ends of said vertical arms is sloped.

18. A sliding door shelf arrangement comprising:

a guide device for sliding doors for shelves, the guide device comprising:

at least two guide rails, wherein each guide rail comprises a guide region for guiding sliding doors, with each guide region comprising at least one groove (3,4,5,6), and each guide rail further comprising a fastening region connected to the guide region for fastening the guide device to shelves, wherein all the guide regions, including the grooves, collectively form a guide arrangement (1) and all the fastening regions in their cooperation form a fastening arrangement (2), wherein the guide device has an installed state where it is engaged to both a generally horizontal shelf and at least one generally vertical sliding door, and an uninstalled state where it is not engaged to a shelf or a sliding door, wherein the fastening arrangement (2) is disposed relative to the guide arrangement so that in the installed state at least one groove (5,6) opens upwards and is accessible for receiving sliding doors from above, at least one groove (3,4) opens downwards and is accessible for receiving sliding doors from below, and the fastening arrangement and shelf are lateral to the grooves, wherein each fastening region is fixed next to a generally vertical front end surface of a horizontal shelf, wherein each guide arrangement at least partially covers the front end surface of a shelf, wherein the guide arrangement (1), including the grooves (3,4,5,6), is disposed laterally adjacent to the fastening arrangement so that the guide arrangement (1) and grooves (3,4,5,6) are oriented out from and in front of the end of the shelf, wherein the fastening arrangement (2) comprises form elements (8) which fasten the guide device to shelves, and wherein the form elements (8) comprise C-shaped clips (9) which are clipped around one or T-shaped shelf ends or T-shaped shelf adapter elements, the sliding door shelf arrangement further comprising:

at least two horizontal shelves, including a high shelf and a low shelf, wherein at least part of the shelves comprise substantially flat tops, bottoms, and edges;

wherein said at least two guide rails of the guide device comprise a high guide rail fixed to the high shelf and a low guide rail fixed to the low shelf;

at least one adapter comprising two substantially parallel spaced apart legs, wherein the at least one adapter is engaged to an edge of at least one shelf by the two spaced apart legs, with a leg contacting the bottom of the shelf and a leg contacting the top of the shelf;

wherein the adapter further comprises a T-shaped shelf adapter element which is complimentary to at least one C-shaped clip form element (8) of at least one guide rail according to claim 1;

the sliding door shelf arrangement further comprising at least one vertical sliding door slidably positioned between the high and low guide rails;

wherein a top edge of the sliding door is positioned in a downward opening groove of the top guide rail, and wherein a bottom edge of the same sliding door is positioned in an upward opening groove of the bottom guide rails.

* * * * *